US005314301A

United States Patent [19]

Knight

[11] Patent Number: 5,314,301

[45] Date of Patent: May 24, 1994

[54] VARIABLE CAMBER STATOR VANE

[75] Inventor: Mark J. Knight, Bridgnorth, England

[73] Assignee: Rolls-Royce plc, London, England

[21] Appl. No.: 17,185

[22] Filed: Feb. 12, 1993

[30] Foreign Application Priority Data

Feb. 13, 1992 [GB] United Kingdom ..... 9203168

[51] Int. Cl.[5] ..... F01D 9/02

[52] U.S. Cl. ..... 415/160; 415/161; 416/23; 416/DIG. 5

[58] Field of Search ..... 415/148, 151, 156, 159, 415/160, 161; 416/23, DIG. 5

[56] References Cited

U.S. PATENT DOCUMENTS

| | | | |
|---|---|---|---|
| 2,145,805 | 1/1939 | Ring | 416/23 |
| 2,337,861 | 12/1943 | Adamtchik | 415/156 |
| 4,000,868 | 1/1977 | Gregor | 416/23 |
| 4,235,397 | 11/1980 | Compton | 416/23 |
| 4,995,786 | 2/1991 | Wheeler et al. . | |

FOREIGN PATENT DOCUMENTS

| | | | |
|---|---|---|---|
| 223194 | 5/1987 | European Pat. Off. . | |
| 274293 | 7/1988 | European Pat. Off. . | |
| 542023 | 1/1977 | U.S.S.R. | 416/23 |
| 736796 | 9/1955 | United Kingdom . | |
| 774501 | 5/1957 | United Kingdom . | |
| 805015 | 11/1958 | United Kingdom . | |
| 893054 | 4/1962 | United Kingdom | 415/161 |
| 1112058 | 5/1968 | United Kingdom . | |
| 1250324 | 10/1971 | United Kingdom . | |
| 1410175 | 10/1975 | United Kingdom | 416/DIG. 5 |

*Primary Examiner*—Edward K. Look
*Assistant Examiner*—James A. Larson
*Attorney, Agent, or Firm*—Oliff & Berridge

[57] ABSTRACT

Conventionally gas turbine engine compressors have fixed inlet guide vanes to give a predetermined swirl to incoming air at an engine design speed, so that air enters the compressor at an optimum angle. At speeds much lower, for example, than the design speed the guide vane is less efficient. The guide vanes are thereby made variable in camber. Each vane comprises a number of spanwise hinged members which can be moved relative one to another to vary the vane camber.

12 Claims, 2 Drawing Sheets

FIG. 3
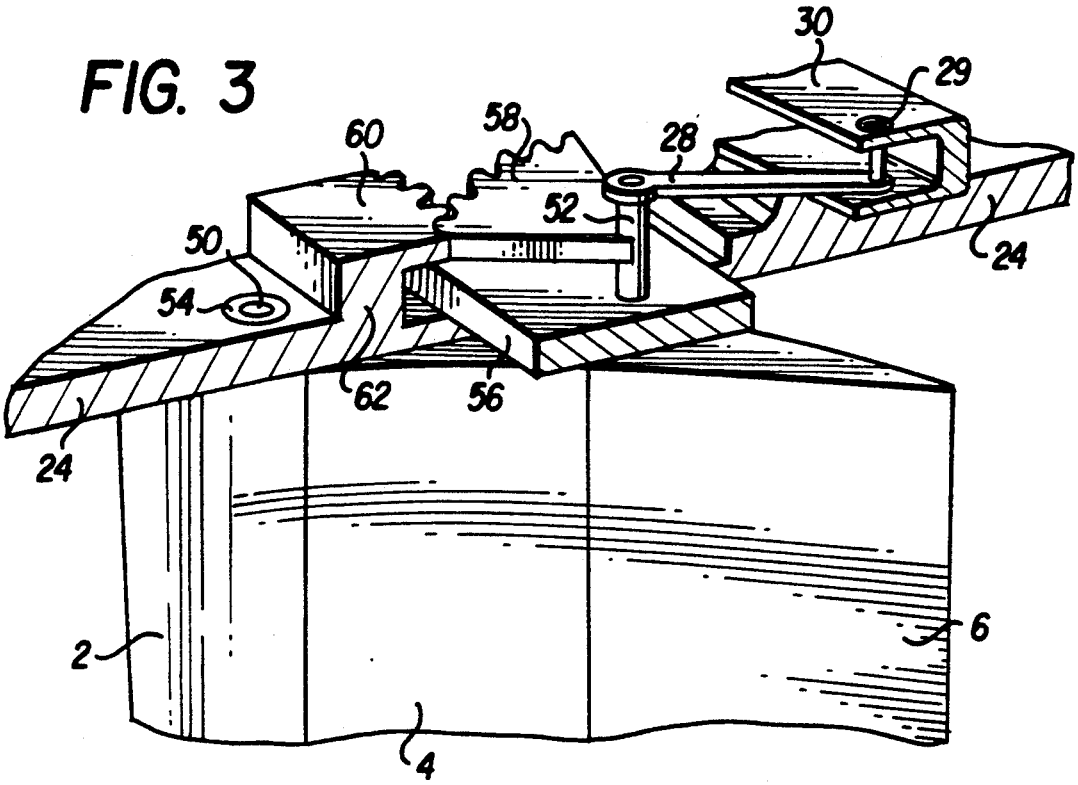
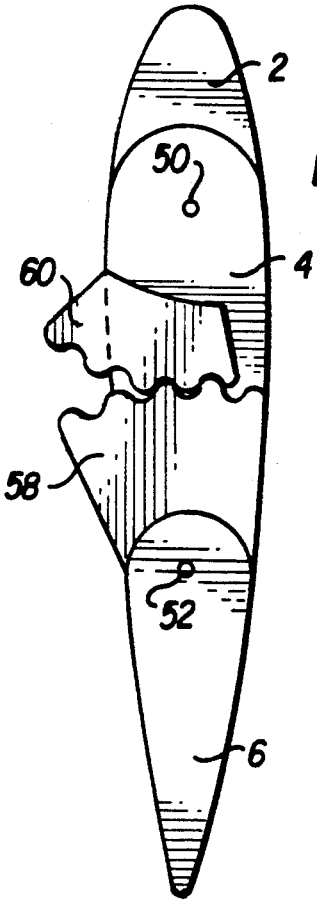
FIG. 4a
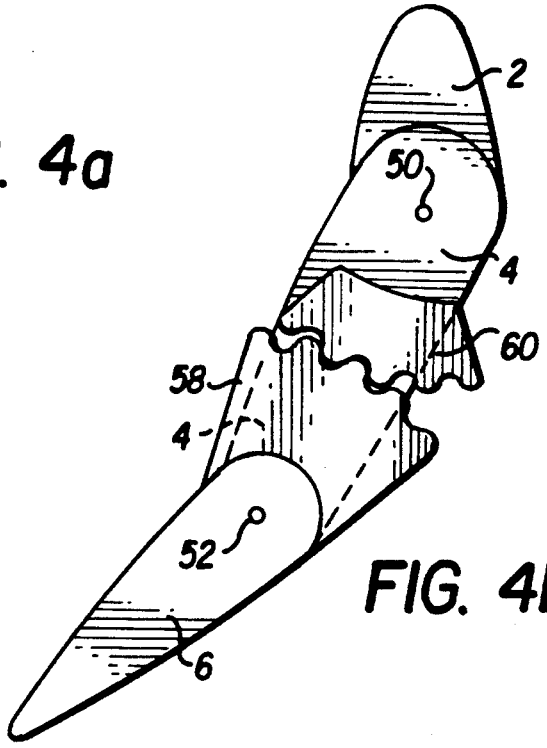
FIG. 4b

VARIABLE CAMBER STATOR VANE

TECHNICAL FIELD

This invention relates to axial flow gas turbine engines. In particular the invention concerns the inlet guide vanes of the compressors of such engines, especially but not necessarily inlet guide vanes.

BACKGROUND ART

It is common for current axial flow gas turbine engines to employ variable stator vanes to vary the flow characteristics of, in particular, the compressor.

For example, the inlet guide vanes are used to widen the design performance of the compressor by changing the air swirl velocity component of inlet air to match the speed of the compressor. This variation of swirl can be achieved by mounting the inlet guide vanes on simple pivots and regulating the angular setting of the vanes in accordance with the compressor speed.

However, if the whole vane is turned the leading edge incidence ceases to be optimal causing significant losses and some of the potential benefits are lost. It is often the case that the swirl angle of air entering the front face of the stator ring is substantially constant. In the case of the first stage fan inlet guide vanes the angle may even be zero, i.e. air flow is virtually wholly axial. The leading edge portion of the guide vane is, therefore, preferably fixed.

Variable camber guide vanes with fixed leading edge incidence are known from GB Patent No 736,796 Rolls-Royce Ltd in which the stator blades are divided longitudinally into a fixed leading edge portion and a relatively pivotable trailing edge for imparting the adjustable swirl characteristics. The trailing part of the vanes are pivotally mounted in the outer engine casing structure, and may be mounted also in the inner stator structure.

The angularly adjustable parts of the whole stator ring are preferably interconnected for simultaneous angular adjustment by means of a coupling ring attached to radius arms carried by spindles which extend from each vane.

A similar type of arrangement is also know from GB Patent No 774,501 in the name of PowerJets (Research and Development) Limited. In this the stator ring is located in the turbine entry and the fixed leading edge part receives substantially axially flowing hot gas from a combustor outlet.

A problem inherent in this type of arrangement arises from an abrupt transition in the airfoil surfaces of the vane at the junction between the fixed and pivoted parts of the structure which precipitate breakaway of the airflow. The present invention attempts to solve this problem by providing a variable camber vane in which the full turning effect is achieved more progressively.

DISCLOSURE OF THE INVENTION

According to the invention there is provided a variable camber stator vane for a gas turbine engine comprising a plurality of vane sections including a leading edge section, at least one mid-chord section and a trailing edge section, said sections being sequentially mounted wherein each section is pivotably mounted relative to its neighbour, a first of the vane sections having a shaft extending radially through the engine casing to receive an actuating input, a mechanism coupling the first vane section with the remaining vane sections for coordinated movement in a predetermined relationship, and an input lever mounted on said shaft for actuating the coupling mechanism to alter the relative disposition of the vane sections whereby to change the camber of the vane.

The invention and how it may be carried out in practice will now be described, by way of example, with reference to two embodiments of the invention illustrated in the accompanying drawings.

FIG. 1 is a detailed view of a variable camber vane including a first operating mechanism, FIG. 2 is a dissembled view of the vane portions of the arrangement of FIG. 1 illustrating the hinge mechanism, FIG. 3 is a detailed view of the vane illustrating a second operating mechanism, and FIGS. *4a,4b* are plan views of the coupling mechanism of FIG. 3 illustrating the meshing gear segments in two different positions.

DESCRIPTION OF THE EMBODIMENTS

Figure 1:
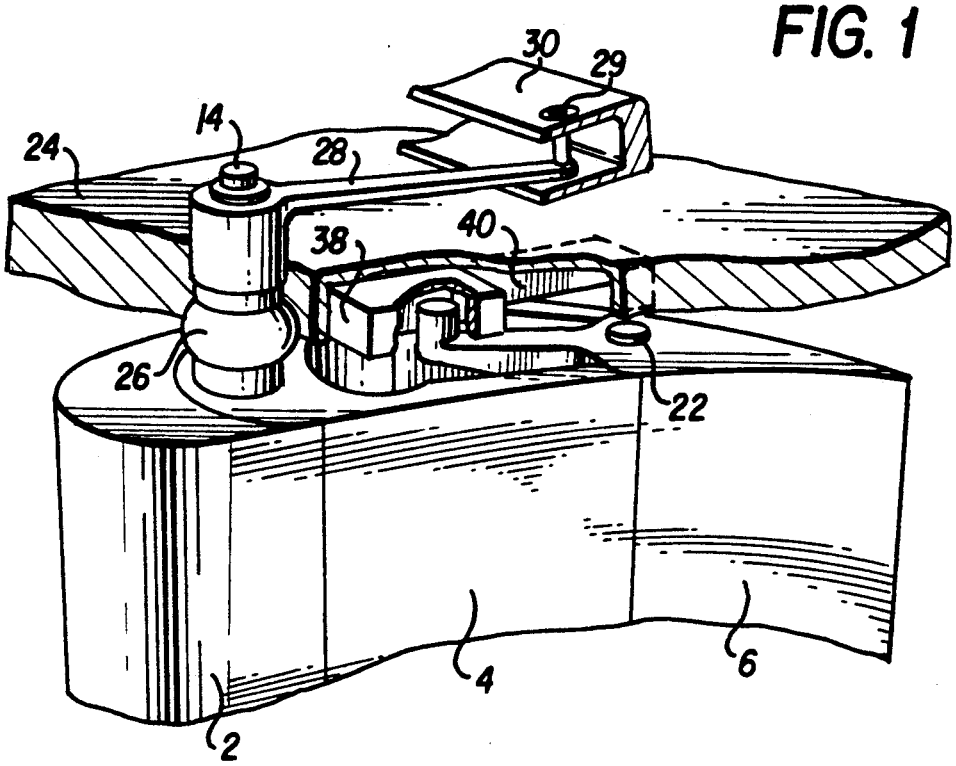
Figure 2:
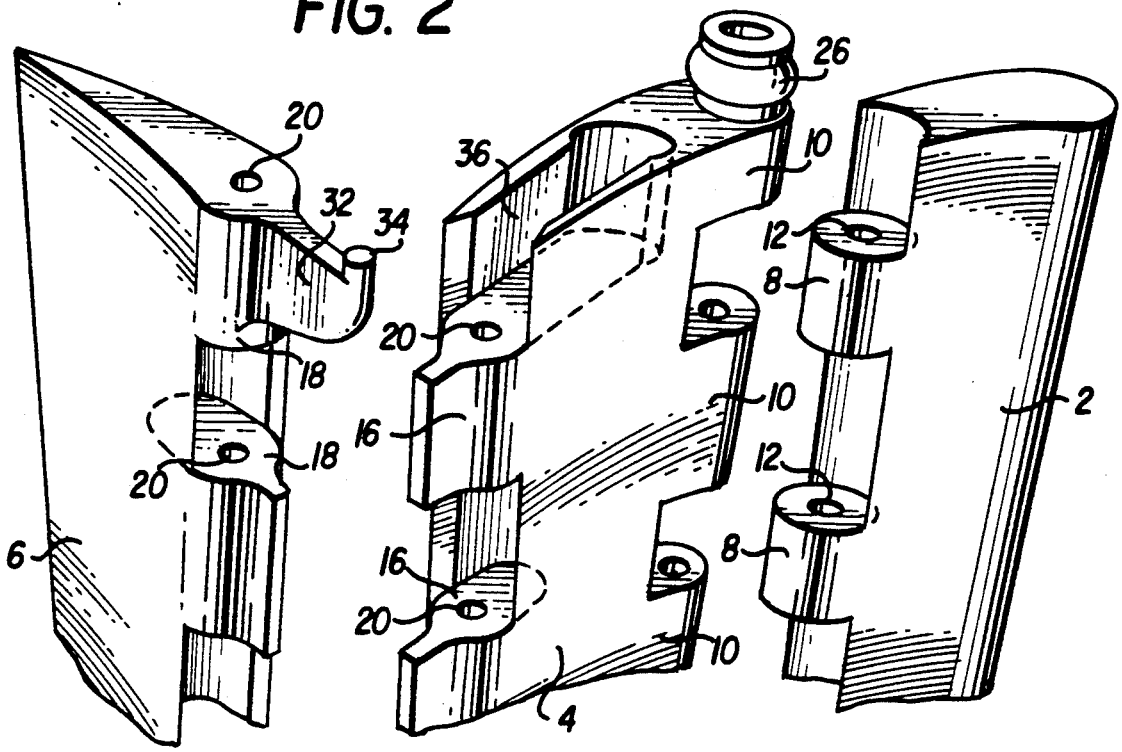

The inlet guide vane shown in FIGS. 1 and 2 comprises three members, namely a fixed leading edge member 2, a mid-chord member 4 and a trailing edge member 6. In FIG. 2 the vane is shown dissembled in order to illustrated more clearly the hinge arrangements. The trailing edge of the leading edge member 2 is sculpted to receive the leading edge of the mid-chord member 4. The adjacent edges of these two sections are formed with interdigitated lugs 8,10 respectively through which are formed co-axial bores 12 to receive a hinge pin 14 (FIG. 1). The trailing edge of the mid-chord member 4 and the leading edge of the trailing edge member 6 are similarly formed with interdigitated lugs 16,18 respectively through which are formed co-axial bores 20 to receive a second hinge pin 22 (FIG. 1). The leading edge, mid-chord, and trailing edge members 2,4,6 are thus articulated together for pivotal movement in order to form a variable camber vane the swirl inducing effect of which can be progressively varied in three steps along its chord.

Leading edge section 2 is fixed in an airflow duct (not shown) at a fixed angle with respect to an incident airflow direction. In a particular example the air flow duct is annular in form and partially defined at its radially outermost wall by engine casing 24, a fragment of which is shown cut away in FIG. 1. The hinge pin 14 projects radially outwards through a journal 26 in the engine casing 24 and at its radially outermost end it is splined to an operating lever 28 the distal end of which is pinned at 29 to a unison ring 30.

The angular disposition of the mid-chord members 4 (fixed to pin 14) is thus controlled by circumferential rotation of the unison ring 30. The angular disposition of each trailing edge member 6, with respect to its respective mid-chord member 4, is controlled by a coupling mechanism now to be described.

The radially outermost lug 18 of each trailing edge section 6 is formed with an axially extending arm 32 the distal end of which carries an upstanding spigot 34. The radially outer end of the mid-chord member 4 is formed with an axially longer recess 36 which receives the arm 32 of the corresponding edge section 6. The dimensions of the assembly are such that the spigot 34 projects slightly above the radially outer end face of the mid-chord member 4. The spigot 34 engages a hollowed out guide block 38 which in turn is slidably engaged with an axially extending slot 40 milled into the inner face of the engine casing 24. For the purpose the casing may be formed with integral thickened bosses adjacent to the end of each vane in order to maintain gas flow integrity of the casing in the region of the milled slots 40.

In operation, the guide block 38 restrains the spigot 34 and thus controls the angular disposition of trailing edge member 6 with respect to its corresponding mid-chord section 4. As the lever 28 is turned, by unison ring 30, to increase the camber between the mid-chord member 4 and the leading edge member 2 then the axis of hinge 22 describes an arc about the axis of hinge 14 and the spigot 34 at the end of arm 32 tends to move guide block 38. The locus of the guide block is determined by the axial direction of slot 40 and this has the action of increasing the turning effect of lever 28 on the trailing edge member 6. The length of arm 32 determines the angular multiplication factor. The resulting effect is that the trailing edge member 6 with respect to the mid-chord member 4 is turned through a slightly greater angle than the mid-chord member 4 with respect to the fixed leading edge member 2.

Referring now to FIGS. 3, 4*a* and 4*b* there is shown a guide vane arrangement of a kind similar to that shown in FIGS. 1 and 2 but which has an alternative coupling mechanism. As before, the guide vane comprises fixed leading edge member 2, mid-chord member 4 and trailing edge member 6 which are formed with interdigitated lugs and span-wise extending hinge pins 50, between members 2 and 4, and 52 between members 4 and 6. The pin 50 between leading edge member 2 and mid-chord member 4 is journaled at 54 in the engine outer casing 24. The radially outer end of pin 50 lies substantially flush with the outer surface of casing 24. The second hinge pin 52, between mid-chord 4 and trailing edge member 6 projects radially outwards and is secured to lever 28 which is in turn pinned at 29 to annular unison ring 30.

The pin 52 extends through an aperture (not shown) formed in the engine casing 24 and is journaled to an annular ring 56 which fits closely around the engine casing 24. The pin 52 is also formed integrally with, or carries, a gear segment 58, which meshes with a second gear segment 60 which is fixed to, or formed integrally with, a boss 62 on engine casing 24. The teeth of gear 58 are formed at a first fixed radius from the axis of pin 52 and the teeth of gear 60 are formed at a second fixed radius from the axis of pin 50. The teeth of gears 58 and 60 are meshed. FIG. 4*a* shows the positions of the vane members 2,4,6 and the relationship between gears 58 and 60 with the vane in an uncambered position. FIG. 4*b* shows the relationship between the vane members and the gear segments with the vane in a fully cambered position.

In operation, to alter the vane camber the annular unison ring 30 is moved in a circumferential direction turning lever 28 about the axis of pin 52. This turning movement rotates gear 58 about the same axis and causes the gear 58 to move around the gear 60. The result is that pin 52 moves circumferentially in the same direction as unison ring 30. Thus, the hinge axis between mid-chord member 4 and trailing edge member 6 is moved pivotally with respect to the axis of pin 50 between leading edge member 2 and mid-chord member 4. The mid-chord member 4 is turned with respect to the leading edge member 2 and the rotation of the gear 58 about the axis of pin 52 rotates the trailing edge member 6 (fixed to pin 52) with respect to the mid-chord member 4. The relative angular deflection of the trailing edge member 6 relative to the mid-chord member 4 is dependent upon the ratio of the radii of the gears 58 and 60 about their respective centre axes. If the ratio is large the trailing edge member will be deflected through a relatively large angle relative to the mid-chord member 4, but if the ratio is small the trailing edge member will be deflected through a relatively small angle relative to the mid-chord member.

It will appreciated that annular ring 56 is not only rotated circumferentially but as the vane in camber is altered it also moves a small distance axially in accordance with the locus of pin 52 about fixed axis pin 50.

In the whole assembly, therefore, an annular array of variable camber vanes is spaced apart around the annular duct interconnected by a series of levers 28 to the unison ring 30 which encircles the outer casing 24.

Although the present invention has been described, by way of example, with specific reference to an inlet guide vane arrangement it will be appreciated that it may be adapted for use in other engine rotations where variable camber is required without departing from the spirit and scope of the invention as defined by the following claims.

We claim:

1. A variable camber stator vane for a gas turbine engine comprising:

a plurality of vane sections including a leading edge section, at least one mid-chord section and a trailing edge section, said sections being sequentially mounted such that the plurality of vane sections are articulated together for pivotal movement, one of the plurality of vane sections being a first driven vane section and having a shaft extending radially through an engine casing to receive an actuating input, a coupling mechanism coupling the first driven vane section with at lease one of the remaining vane sections for coordinated movement in a predetermined relationship, an input lever mounted on the shaft for actuating the coupling mechanism to alter the relative disposition of the vane sections whereby to change the camber of the vane, wherein the leading edge vane section is fixed relative to the engine casing, and the first driven vane section comprises the mid-chord section pivotally mounted to a trailing edge of the leading edge section, the trailing edge vane section is pivotally mounted to a trailing edge of the mid-chord section, the coupling mechanism determines the angular disposition of the trailing edge vane section relative to the mid-chord section in accordance with the angular displacement of the mid-chord section relative to the leading edge vane section, the coupling mechanism progressively increases the displacement of the trailing edge vane section relative to the mid-chord section as the mid-chord section displacement increases relative to the leading edged vane section, and the coupling mechanism comprises a guide slot in the engine casing, a guide block engaged with the guide slot, and a spigot carried by the trailing edge vane section, which engages the guide block.

2. A variable camber stator vane for a gas turbine engine as claimed in claim 1 wherein the trailing edge section is formed with an axially projecting arm on the distal end of which is carried the spigot engaged with the guide block.

3. A variable camber stator vane for a gas turbine engine having a generally cylindrical engine casing comprising:

a plurality of vane sections articulated together for pivotal movement, including a driving section having a shaft extending radially through the engine casing to receive an actuating input;

actuation means for moving the actuating input; and a coupling mechanism coupling the driving section with at lease one of the remaining vane sections for coordinated movement in a predetermined relationship, the remaining sections comprising at least a final vane section, the coupling mechanism comprising:

a guide slot in the engine casing;

a movable guide means engaged with the guide slot; and a spigot carried by the final vane section, which engages the guide means, whereby movement of the driving section by the actuating means effects movement of the spigot along the guide slot by way of the movable guide means thereby altering relative dispositions of the plurality of vane sections and changing the camber of the variable camber stator vane.

4. A variable camber stator vane as claimed in claim 3, wherein the final vane section is formed with an axially projecting arm having a distal end, the spigot being formed on the distal end.

5. A variable camber stator vane as claimed in claim 3, further comprising a leading edge vane section fixed relative to the engine casing.

6. A variable camber stator vane as claimed in claim 5, wherein the driving section comprises a mid-chord vane section pivotally mounted to a trailing edge of the leading edge vane section.

7. A variable camber stator vane as claimed in claim 6, wherein the final vane section is pivotally mounted to a trailing edge of the mid-chord vane section.

8. A variable camber stator vane as claimed in claim 7, wherein the coupling mechanism determines the angular disposition of the final vane section relative to the mid-chord vane section in accordance with the angular displacement of the mid-chord section relative to the leading edge vane section.

9. A variable camber stator vane as claimed in claim 8, wherein the coupling mechanism progressively increases the displacement of the final vane section relative to the mid-chord vane section, as the mid-chord section displacement increases relative to the leading edge vane section.

10. A variable camber stator vane for a gas turbine engine, comprising:

a plurality of vane sections including a leading edge section, at least one mid-chord section and a trailing edge section, said sections being sequentially mounted such that the plurality of vane sections are articulated together for pivotal movement, one of the plurality of vane sections being a first driven vane section and having a shaft extending radially through an engine casing to receive an actuating input, a coupling mechanism coupling the first driven vane section with at lease one of the remaining vane sections for coordinated movement in a predetermined relationship, an input lever mounted on said shaft for actuating the coupling mechanism to alter the relative disposition of the vane sections whereby to change the camber of the vane, wherein the leading edge vane section is fixed relative to the engine casing, and the first driven vane section comprises the mid-chord vane section pivotally mounted to a trailing edge of the leading edge section, the trailing edge section is pivotally mounted to a trailing edge of the mid-chord section, the coupling mechanism determines the angular disposition of the trailing edge section relative to the mid-chord section in accordance with the angular displacement of the mid-chord section relative to the leading edge section, the coupling mechanism progressively increases the displacement of the trailing edge section relative to the mid-chord section as the mid-chord section displacement increases relative to the leading edge section, and the coupling mechanism comprises meshing gears including a fixed gear segment and a rotatable gear segment mounted on the pivot axis of the mounting between the mid-chord and trailing edge vane sections.

11. A variable camber stator vane for a gas turbine engine as claimed in claim 10 wherein the gear of the fixed gear segment is formed on a first radius the centre of which is the axis of the pivotal mounting of the mid-chord section relative to the leading edge section and the gear of the rotatable gear segment is formed on a second radius the centre of which is the axis of the pivotal mounting of the mid-chord section relative to the trailing edge section.

12. A variable camber stator vane for a gas turbine engine as claimed in claim 11 wherein the angular disposition of the mid-chord section relative to the leading edge section is determined by circumferential movement of the pivot axis of the trailing edge section relative to the mid-chord section and the angular disposition of the trailing edge section relative to the mid-chord section is determined by the ratio of the radii of the fixed gear and the movable gear.

* * * * *